US007055693B1

(12) United States Patent
Goff

(10) Patent No.: US 7,055,693 B1
(45) Date of Patent: Jun. 6, 2006

(54) MULTI-PURPOSE MEDICINE ORGANIZER

(76) Inventor: Bradley E. Goff, 18 Buckingham Ct., Cartersville, GA (US) 30120

( * ) Notice: Subject to any disclaimer, the term of this patent is extended or adjusted under 35 U.S.C. 154(b) by 32 days.

(21) Appl. No.: 10/027,497

(22) Filed: Dec. 21, 2001

(51) Int. Cl.
*B65D 83/04* (2006.01)

(52) U.S. Cl. ..... 206/528; 206/538

(58) Field of Classification Search ..... 206/528, 206/534, 535, 538, 540, 438, 217, 509, 570, 206/507, 38, 546, 549, 577, 501; 211/85.13; 220/524, 4.26–4.28; 312/126, 198, 201; 294/144, 145
See application file for complete search history.

(56) References Cited

U.S. PATENT DOCUMENTS 3,160,306 A * 12/1964 Smalley ..... 220/512
4,201,290 A 5/1980 Madden
4,473,156 A 9/1984 Martin
4,693,371 A 9/1987 Malpass
4,694,961 A * 9/1987 Menendez ..... 206/508
4,749,085 A 6/1988 Denney
4,753,340 A 6/1988 Blakeman et al.
5,011,018 A * 4/1991 Keffeler ..... 206/538
5,050,756 A * 9/1991 Tielker et al. ..... 220/23.4
5,062,531 A 11/1991 Coy
5,351,818 A 10/1994 Daneshvar
5,379,899 A * 1/1995 Thurell ..... 206/538
5,664,689 A 9/1997 Mirlisena, Sr.
5,967,323 A * 10/1999 Siragusa ..... 206/509
6,062,389 A * 5/2000 Kent ..... 206/518
6,138,831 A * 10/2000 Agostinelli ..... 206/217
6,269,949 B1 * 8/2001 Gottlieb ..... 206/519

* cited by examiner

*Primary Examiner*—Luan K. Bui
(74) *Attorney, Agent, or Firm*—Woodard, Emhardt, Moriarty, McNett & Henry LLP

(57) ABSTRACT

Described is a preferred medicine organizer including both pill bottle and individual pill storage units. Preferred devices include upper and lower frame members removably attached to one another, with one providing the bottle storage unit and the other providing the individual pill storage unit. Preferred medicine organizers also include nestable components whereby multiple identical medicine organizers can be nested atop one another.

15 Claims, 10 Drawing Sheets

MULTI-PURPOSE MEDICINE ORGANIZER

BACKGROUND

The present invention relates generally to medicine storage and dispensing apparatuses, and in particular to a medicine organizer useful for storing and dispensing pills that includes a pill storage unit and a bottle storage unit.

As further background, a variety of medicine organizer designs have been proposed, many with the goal of improving patient compliance with prescribed regimens of medication. These medicine organizers have attempted to provide means for the patient to conveniently store medications pending further use, and/or to readily dispense those medications at the time of use. For example, U.S. Pat. No. 4,693,371 to Malpass describes a medication dispenser and container that includes a tray divided into multiple cavities, each for containing a medicine. Each cavity is divided into an accessible portion and an inaccessible portion, the latter being covered by a transparent wall and containing an exemplary dosage of the medicine to be taken.

In another example, U.S. Pat. No. 4,473,156 to Martin describes a tray apparatus having multiple pill-containing cavities including daily indicia and time-of-day indicia. The time-of-day indicia includes color coding. As disclosed in this patent, the tray apparatus may be stored in a box and pill bottles may be stored atop the box and color coordinated with the colors on the tray apparatus. U.S. Pat. No. 4,749,085 discloses another pill tray that is divided into multiple compartments with daily and time-of-day indicia.

U.S. Pat. No. 4,753,340 to Blakeman et al. discloses a device for storing and carrying medicines. The device provides removable fastening of the original containers of medicine using hook and eye fasteners such as Velcro. The medicine containers are fastened to vertical wall members which are mounted on a turn table base. U.S. Pat. No. 5,351,818 to Daneshbar discloses a medicine box that has a hinged lid to close a generally rectangular enclosure. The enclosure includes a lower portion for holding pill bottles and an overlying weekly pill container resting atop walls within the rectangular enclosure. The weekly pill container is smaller in dimension than the box in a fashion that provides an area toward the front of the box to house taller pill bottles.

U.S. Pat. No. 5,644,689 to Mirlisena discloses a shelf organizer that includes a shelf having cylindrical sleeves mounted under the shelf, for use in a medicine cabinet. The cylindrical sleeves are sized to accommodate bottles, tubes or similar items containing medicines.

In view of this background, there remain needs for improved medicine organizers which provide both pill-storage and bottle-storage features, which may be flexibly used to organize medicines of a prescribed regimen, and which are effectively transportable by the user. The present invention is addressed to these needs.

SUMMARY OF THE INVENTION

Accordingly, in one aspect, the present invention provides a medicine organizer useful for storing and dispensing pills. The organizer includes an organizer body having an upper end, a lower end, and side walls connecting the upper end to the lower end. The upper and lower ends of the organizer are configured to provide a nestable relationship among two of the organizer bodies. The organizer includes a bottle storage unit configured to stably retain medicine bottles, preferably of varying sizes, for example having a plurality of bottle openings each for receiving a pill bottle of corresponding size. The organizer also includes a pill storage unit for receiving a supply of individual pills to be taken on a periodic basis, for example a daily basis. The pill storage unit has a plurality of pill compartments each for receiving a supply of pills.

In another aspect, the present invention provides a medicine organizer useful for storing and dispensing pills including an organizer body having a first frame member removably connected to a second frame member. The first frame member provides a bottle storage unit of the organizer body, for example wherein the bottle storage unit has a plurality of bottle openings each for receiving a pill bottle. The second frame member provides a pill storage unit of the organizer body for receiving a supply of pills to be taken on a periodic basis, such as a daily basis. The pill storage unit has a plurality of pill compartments each for receiving a supply of pills.

A still further embodiment of the present invention provides a medicine organizer that includes an organizer body, a bottle storage unit of the organizer body, and a pill storage unit of the organizer body. The bottle storage unit has a plurality of bottle openings each for receiving a pill bottle. The pill storage unit includes a plurality of pill compartments each for receiving a supply of pills to be taken on a periodic basis. A plurality of individual pill trays are included to provide the plurality of pill compartments.

The present invention provides improved, multi-purpose medicine organizers that are useful for storing and dispensing pills. Additional embodiments as well as features and advantages of the invention will be apparent from the descriptions herein.

DESCRIPTION OF THE FIGURES

FIGS. 8A through 11A provide perspective views of variously-sized and constructed bottle holders for use in the invention, and FIGS. 8B through 11B show top view of the holders of FIGS. 8A through 11A, respectively.

DESCRIPTION OF THE PREFERRED EMBODIMENTS

Figure 1:
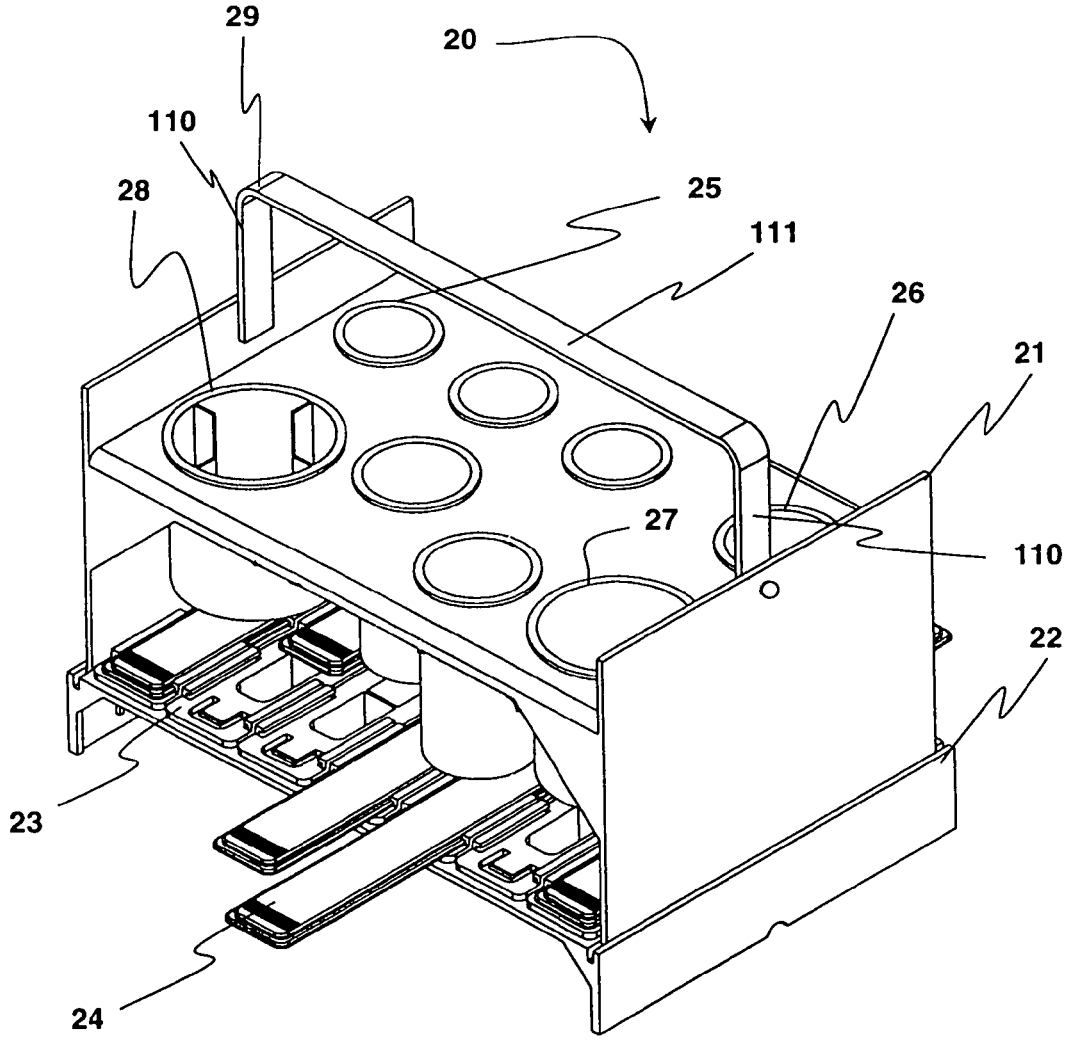
FIG. 1 provides a perspective view of a medicine organizer in accordance with the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, and alterations and modifications in the illustrated device, and further applications of the principles of the invention as illustrated therein are herein contemplated as would normally occur to one skilled in the art to which the invention relates.

As disclosed above, the present invention provides medicine organizers useful for storing and dispensing medicines in pill form. With reference now to FIG. 1, shown is a perspective view of a medicine organizer 20 in accordance with the present invention. Medicine organizer 20 generally includes an upper frame member 21 and a lower frame member 22. Mounted within lower frame member 22 are a plurality of trays 23 for receiving a supply of pills to be taken on a periodic basis, for example a daily basis. Each tray 23 is supplied with a tray lid 24 which is moveable so as to selectively cover and uncover subcompartments within the tray 23. The preferred medicine organizer 20 is provided with a plurality of bottle holders received within its upper frame member 21. In the illustrated organizer 20, provided are small-diameter bottle holders 25, medium-diameter bottle holders 26, and a large-diameter bottle holder 27, adapted to receive bottles of corresponding size or smaller. Also shown is a modified bottle holder 28 having radially inwardly extending flanges so as to stably receive a bottle of significantly smaller diameter. Medicine organizer 20 also includes a handle 29 for transporting the medicine organizer 20 from its intended storage location, for example a medicine cabinet within the household of a patient, to a physician's office, pharmacy, etc.

Figure 2:
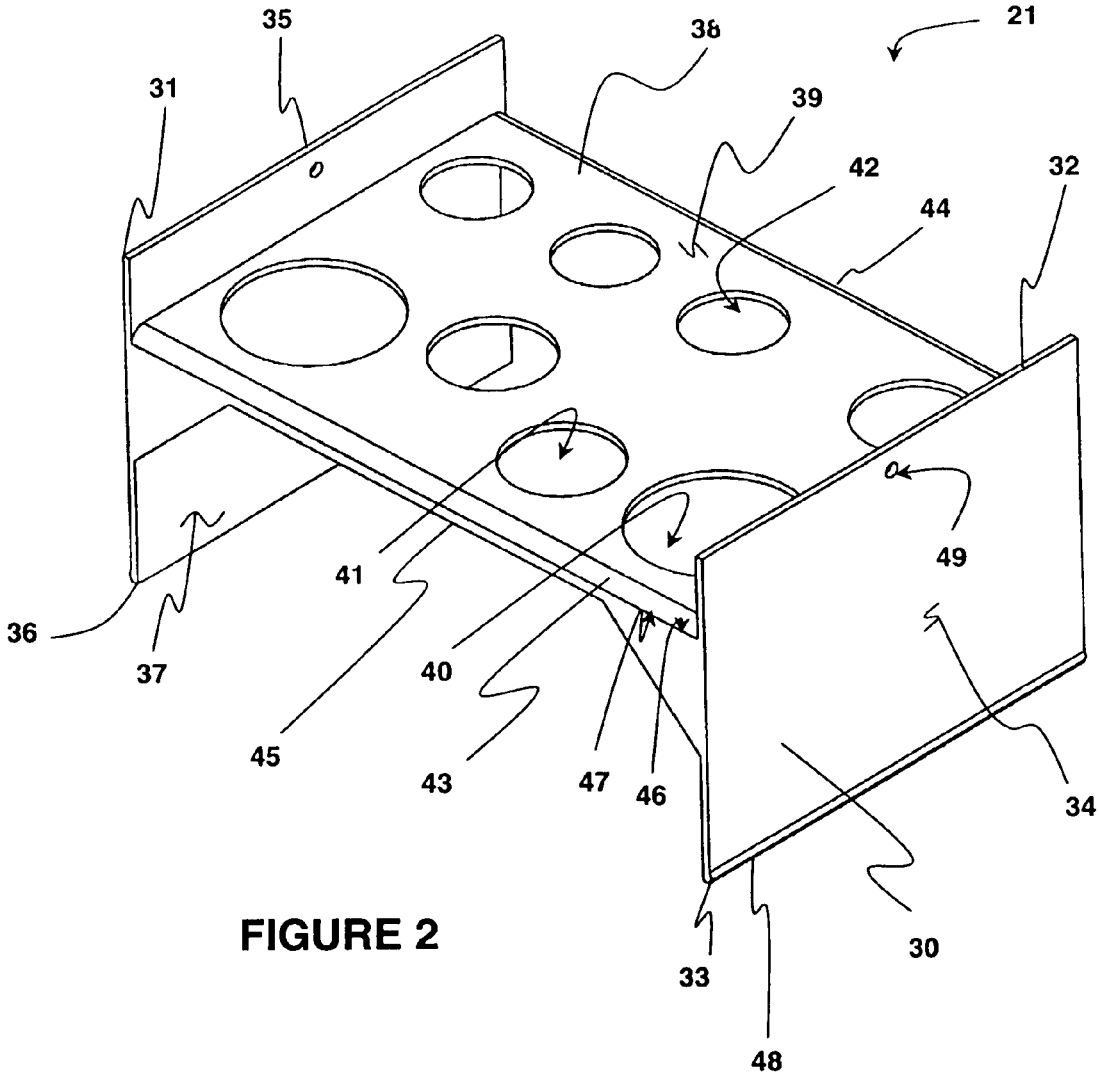
FIG. 2 provides a perspective view of an upper portion of an organizer body of the invention, providing a bottle storage unit.

With reference now to FIG. 2, shown is a perspective view of the upper frame member 21 depicted in FIG. 1. Upper frame member 21 includes a first generally vertically-extending support 30 and a second generally vertically-extending support 31. First support 30 includes a top edge 32, a bottom edge 33, and a wall 34 extending therebetween. Similarly, support 31 includes top and bottom edges 35 and 36 respectively, and a wall 37 extending therebetween.

Upper frame member 21 also includes a generally horizontal panel 38 presenting an upper panel surface 39. Panel 38 defines a plurality of openings of varied size including relatively larger openings 40, mid-sized openings 41, and small openings 42, for receiving pill bottles directly, or for receiving pill bottle holders adapted to receive and support pill bottles. When bottles are received directly within openings 40–42, such openings are desirably sized to receive the bottles but not the bottle lids or another proturbance thereupon, so as to store the bottles in a suspended fashion through the openings 40–42. Upper panel member 38 also presents generally rounded or beveled front and back edges 43 and 44, respectively.

In the illustrated embodiment, the panel member 38 is manufactured as a separate piece from the support members 30 and 31. Thus, support members 30 and 31 are connected to one another by front and rear cross-pieces 45 which present upper surfaces 46 for contacting lower surfaces 47 of the front and back edges 43 and 44 of the panel member 38. In this fashion, the horizontal panel member 38 is stably received upon the frame unit provided by the integrally formed support members 30 and 31 and cross pieces 45. Optionally, panel member 38 can be bonded or otherwise attached to the support members 30 and 31, and/or the cross-pieces 45, including being integrally formed therewith. Support members 30 and 31 include proturbences 48 along their bottom edges 33 and 36 to facilitate a snug friction fit with lower frame member 22 as described further below. First and second support members 30 and 31 also include apertures 48 for receiving cooperating handle elements as described further below.

Figure 3:
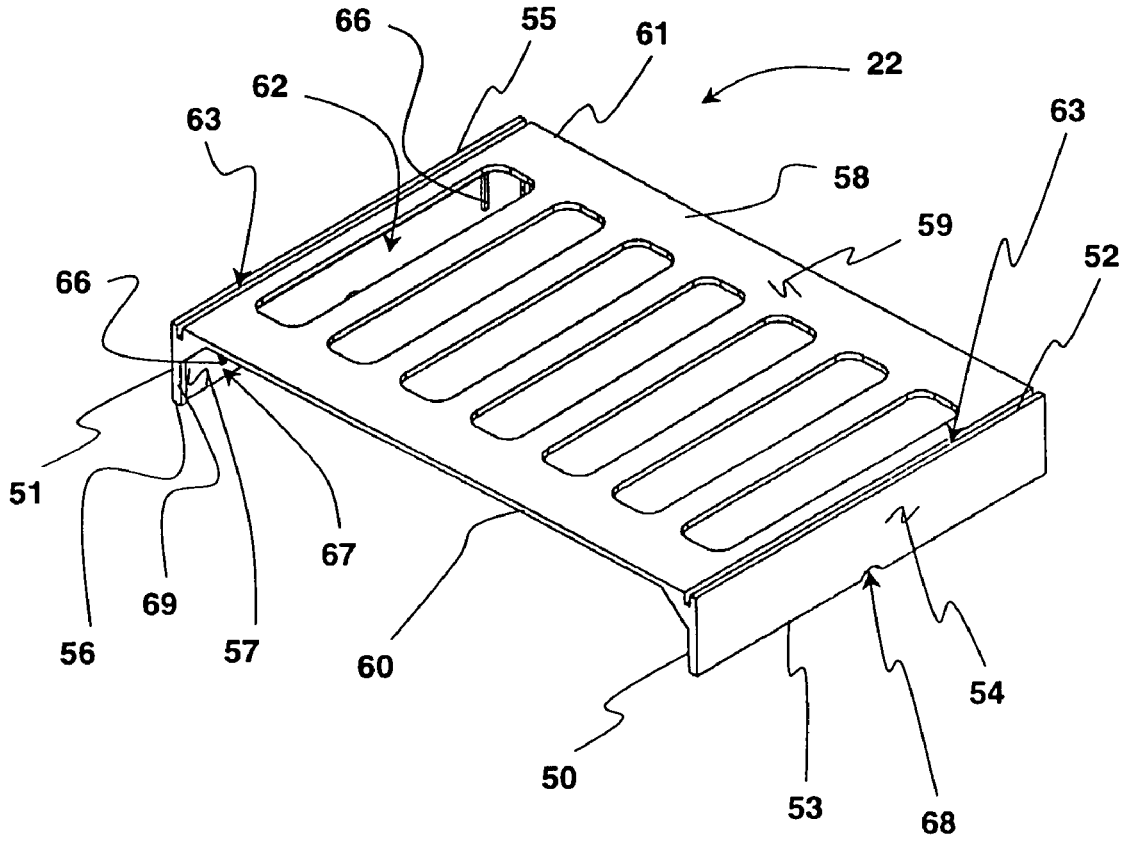
FIG. 3 provides a perspective view of a lower portion of an organizer body of the invention, providing a pill storage unit.

With reference now to FIG. 3, shown is a perspective view of the lower frame member 22 depicted in FIG. 1. Lower frame member 22 includes a first vertical support 50 and a second vertical support 51. First vertical support 50 includes a top edge 52, a bottom edge 53, and a wall 54 extending therebetween. Second support member 51 includes a top edge 55, a bottom edge 56, and a wall 57 extending therebetween. Lower frame member 22 also includes a generally horizontally-extending lower panel member 58 presenting an upper surface 59. Lower panel member 58 has a front edge 60 and a back edge 61, and defines a plurality of elongate openings 62 for receiving pill trays. Lower frame member 22 presents upwardly-facing grooves 63 at its lateral perimeters extending generally parallel to first and second support members 50 and 51. Grooves 63 present a bottom wall 64, and side walls 65, and are adapted to receive the bottom edges 33 and 36 of upper frame members 30 and 31, respectively (see FIG. 2).

Located on inner surfaces of support members 50 and 51 are pegs or other proturbences 66 to facilitate proper spacing and stability during nesting of two organizers together. In particular, proturbences 66 present lower surfaces 67 which contact the top edges 32 and 35 of the first and second support members 30 and 31, respectively, of the upper frame member 21 (see FIG. 2). First and second lower frame support members 50 and 51 also define generally arcuate cut-out portions 68 which contact and cooperate with a corresponding handle connector element as will be described in more detail below in connection with FIGS. 1, 12, and 13. Support members 50 and 51 of lower frame member 22 also present vertically-extending shoulders 69 at each corner of lower frame member 22 so as to abut the surfaces presented by the vertically-extending front and rear edges of the upper frame supports 30 and 31. In this fashion, the front-to-back movement of a lower frame member 22 while nested atop an upper frame member 21 is resisted.

Figure 4:
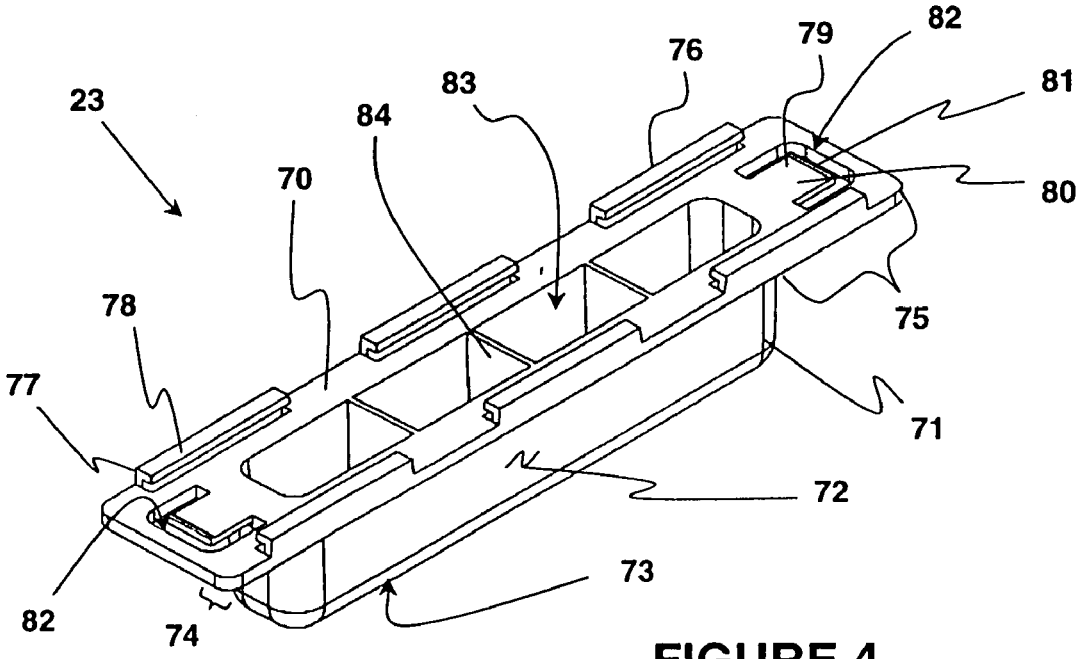
FIG. 4 provides a perspective view of a pill tray for incorporation in a medicine organizer of the invention.
Figure 6:
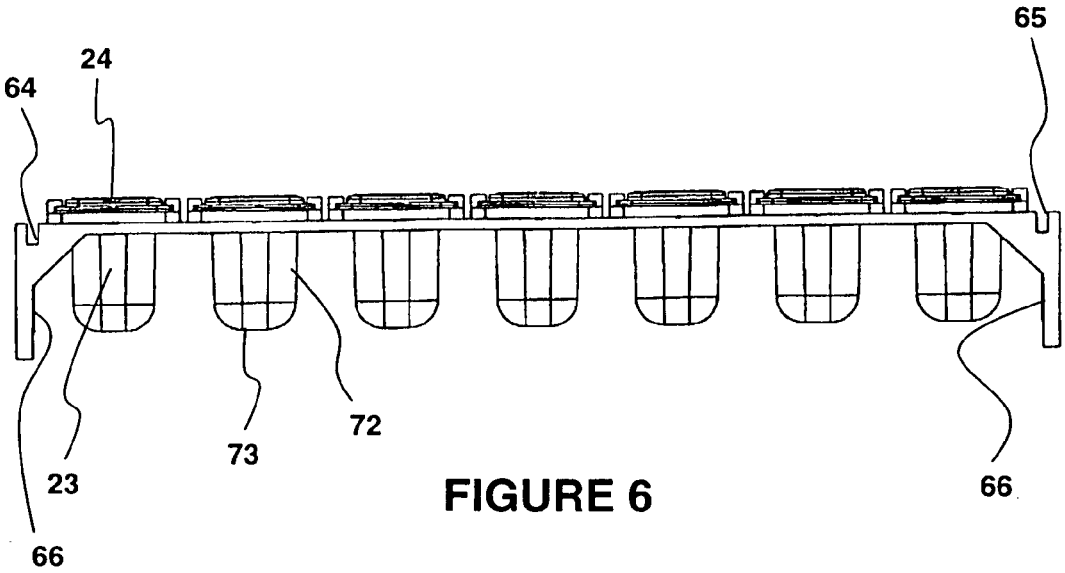
FIG. 6 provides a plan view of an assembled lower portion of an organizer body of the invention, providing a pill storage unit.
Figure 7:
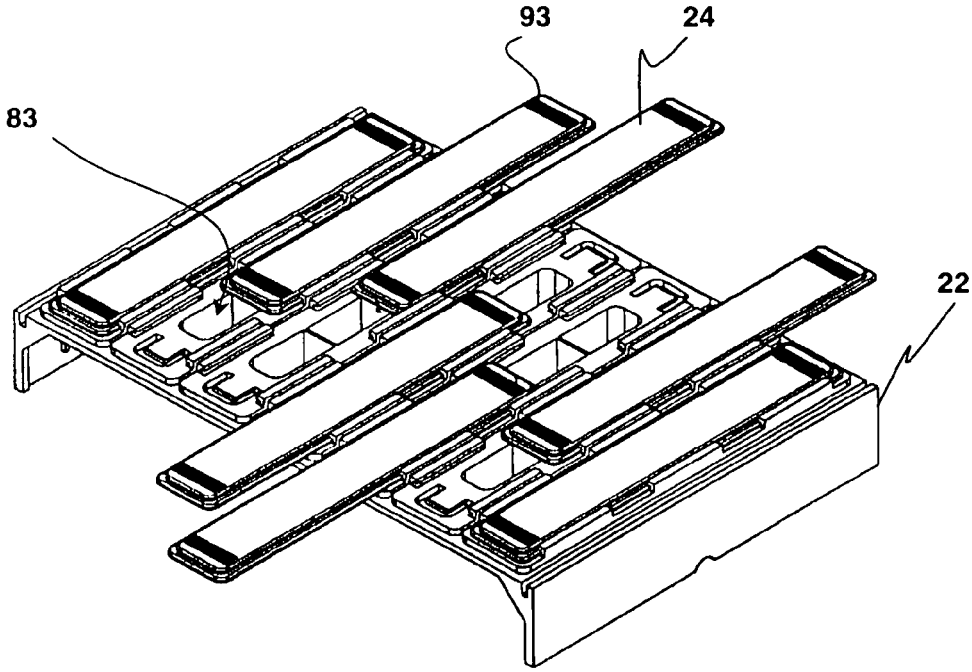
FIG. 7 provides a perspective view of the assembly shown in FIG. 6 with tray lids shown in various positions.

With reference now to FIGS. 4, 6 and 7, shown is a perspective view of a pill tray 23 as depicted in FIG. 1 (FIG. 4), and plan and perspective views of pill trays 23 received within a lower frame member 22 (FIGS. 6 and 7). Pill tray 23 includes a generally horizontally-extending tray panel 70 having a container 71 depending therefrom. Container 71 includes vertically-extending side wall 72 and a bottom wall 73, for retaining individual pills within the container 71. Horizontal tray panel 70 has a perimeter having portions dimensioned greater than the perimeter of container 71 and thereby presents both laterally-extending overhangs 74 and frontwardly- and rearwardly-extending overhangs 75, providing shoulders for supportive contact with upper surface 59 (FIG. 3) of horizontal panel 58 of lower frame member 22 when the tray 23 is received within its corresponding elongate opening 62. A plurality of retaining elements 76 extend upwardly from tray panel 70 and include a vertical leg 77 and a horizontal leg 78. In this fashion, each retainer element 76 alone provides a groove, and all in combination provide a slot adapted to receive a tray lid 24 as discussed below. Tray panel 70 also includes detent members 79 for cooperating with corresponding surface features of the tray lid 24. Detent members 79 include a flexion element 80 which deforms upon the application of force, and a catch portion 81 for contact and cooperation with surface features of tray lid 24. Detent member 79 has an external perimeter defined by a generally U-shaped gap 82 in horizontal tray panel 70. Further, in the depicted tray 23, container 71 is divided into a plurality of subcompartment 83 by walls 84 positioned within and spanning the lateral cross section of container 71.

Figure 5A:
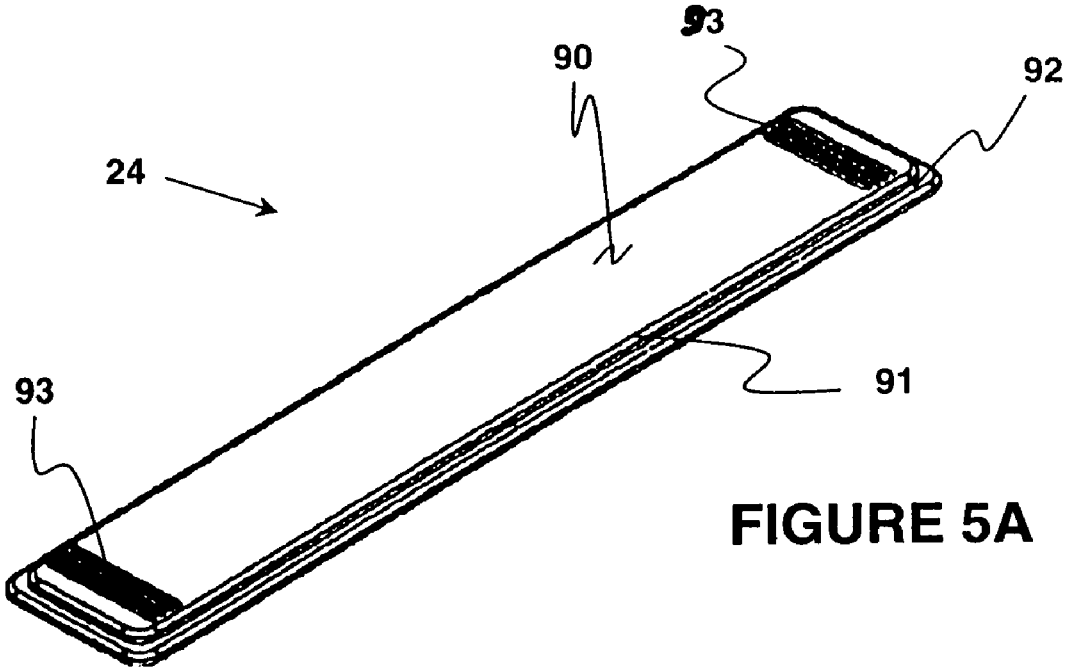
FIGS. 5A and 5B provide perspective views of top and bottom sides of a pill tray lid, respectively.
Figure 5B:
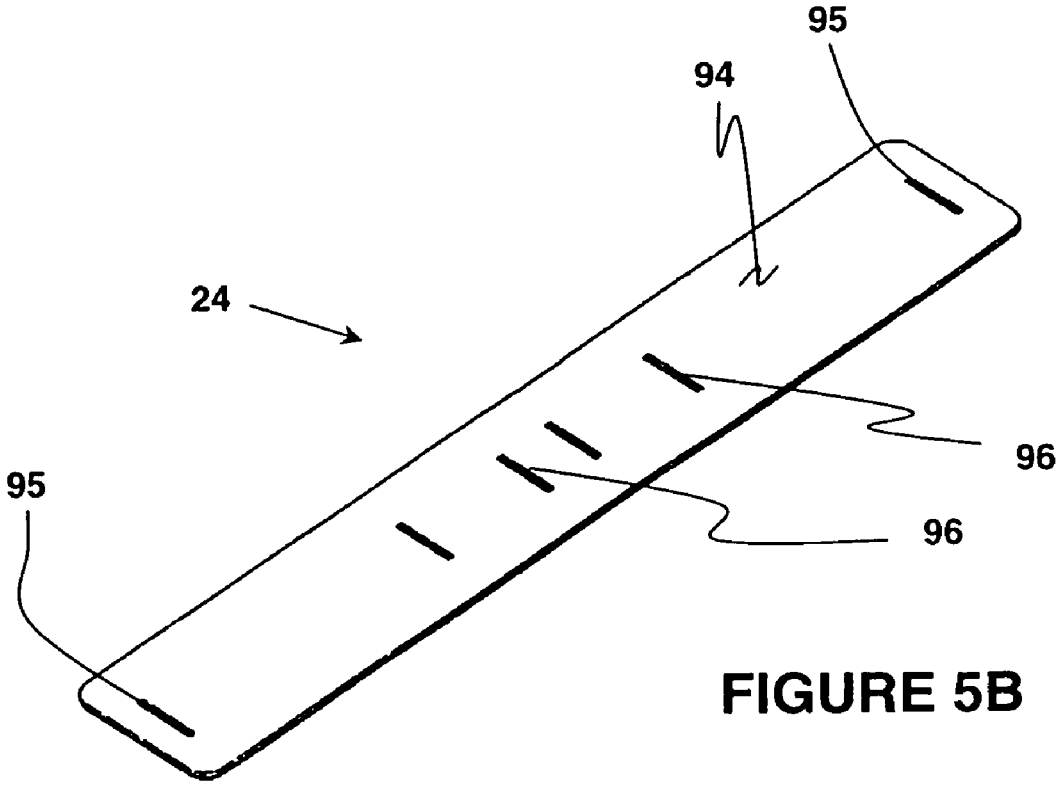

Referring now to FIGS. 5A and 5B, shown are perspective views of the top and bottom portions of a tray lid 24. Shown in FIG. 5A is the top portion presenting an upper surface 90 and a shoulder 91 transitioning between surface 90 and lower perimeter surface 92 bounding the perimeter of the tray lid 24.

Upper surface 90 of tray lid 24 also presents gripping portions 93 adjacent each end of tray lid 24 which in use facilitate translation of the tray lid 24 forwardly and/or rearwardly when tray lid 24 is received within the slot defined by retainer elements 76 of the tray 23 (FIG. 4). Gripping members 93 may be provided by recesses, proturbences as shown, or any other structural feature facilitating translation of the tray lid 24. With reference now to FIG. 5B, tray lid 24 presents a lower surface 94 having a plurality of elongate recesses therein dimensioned correspondingly to the catch portion 81 of the detent member 79 (FIG. 4). In particular, lower surface 94 of tray lid 24 has end-stop recesses 95 which in cooperation with detent member 79 provide friction stops corresponding to completely open and completely closed positions of the tray lid 24 relative to the tray 23. Lower surface 94 of tray lid 24 also has a plurality of recesses 96 intermediate the end-stop recesses 95 and positioned to provide indexing friction stops wherein tray lid is open to an extent to provide access to individual ones of the subcompartments 83 of the container 71 of tray 23 (see FIG. 7). The friction stops provided by recesses 95 and 96 and detent members 79 are sufficient to stop the translation of tray lid 24 under normal forces applied during use, but are overcomeable by the patient upon the application of increased force. In this manner, a patient may selectively translate the lid to completely closed, completely open, or partially open positions to provide access to the container 71 as a whole or subcompartments 83 thereof.

Figure 8B:
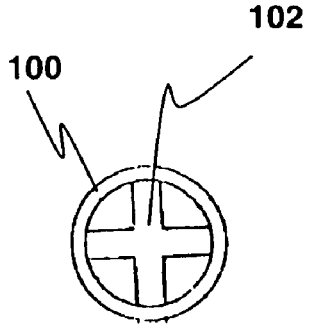
Figure 8A:
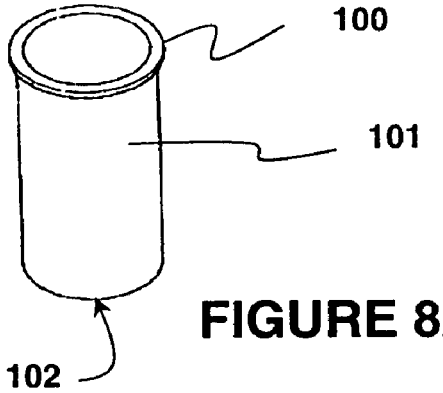
Figure 9B:
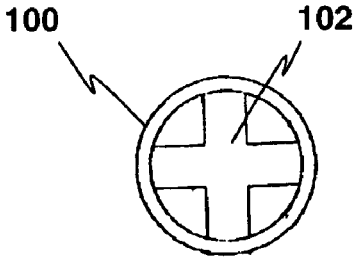
Figure 9A:
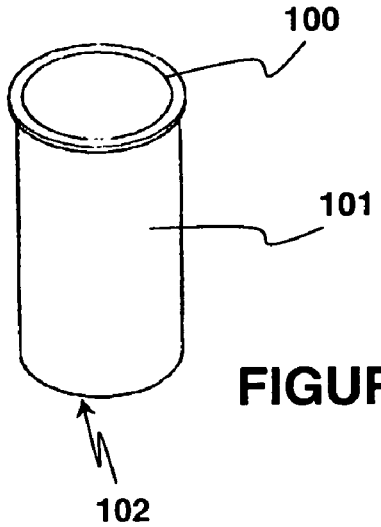
Figure 10B:
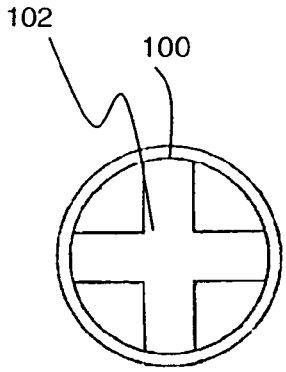
Figure 10A:
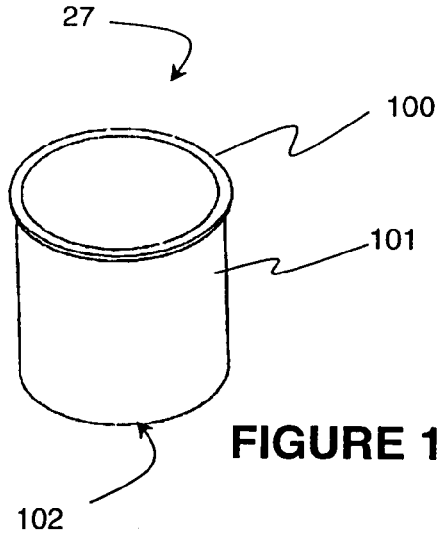

With reference now to FIGS. 8A through 11A and 8B through 11B, shown are variously-sized bottle holders that can optionally be used with medicine organizers of the present invention. FIGS. 8A and 8B depict a relatively small holder, FIGS. 9A and 9B depict a relatively mid-sized holder, and FIGS. 10A and 10B depict a relatively large holder. Each has similar elements which are therefore similarly numbered. Each includes an upper ring 100 and generally cylindrical side walls 101 depending therefrom. The external perimeter of upper ring 100 is dimensioned greater than the perimeter of cylindrical side walls 101, thereby providing a shoulder and a lower surface of ring 100 to provide supportive contact with the upper surface 39 presented by horizontal panel 38 of upper frame member 21 (FIG. 2) when the bottle holder 25, 26, 27 and/or 28 is received within an opening 40, 41, or 42 having a diameter sufficient to receive cylindrical side walls 101 of the bottle holder but insufficient to pass the upper ring 100. Cup holders 25 through 28 also have bottom walls 102 for supporting bottles received within bottle holders 25 through 27.

Figure 11B:
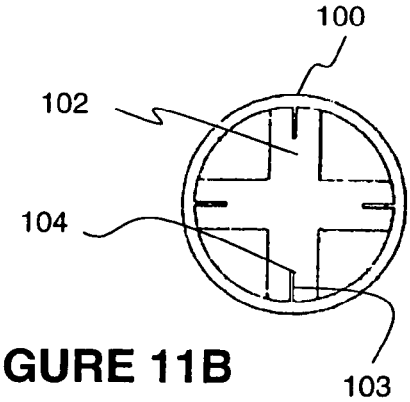
Figure 11A:
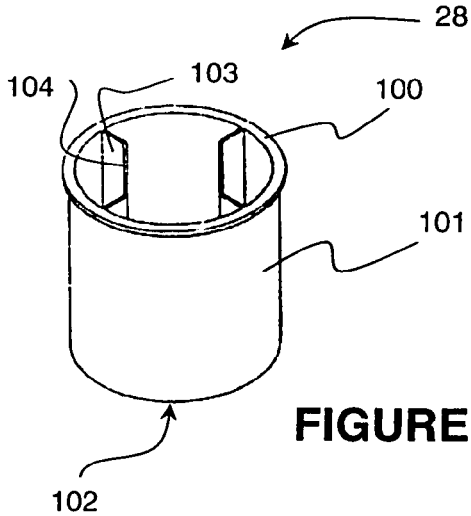

Referring now particularly to FIGS. 11A and 11B, shown is a modified bottle holder 28 dimensioned similarly to holder 27. Holder 28, however, also includes inwardly-extending flanges 103 that provide vertically-extending end surfaces 104 for contacting and retaining bottles having a diameter significantly smaller than the diameter of cylindrical side walls 101. In this fashion, bottle holder 28, when incorporated in the medicine organizer, can convert a relatively large opening 40 to the purpose of stably holding a relatively smaller bottle.

Figure 12:
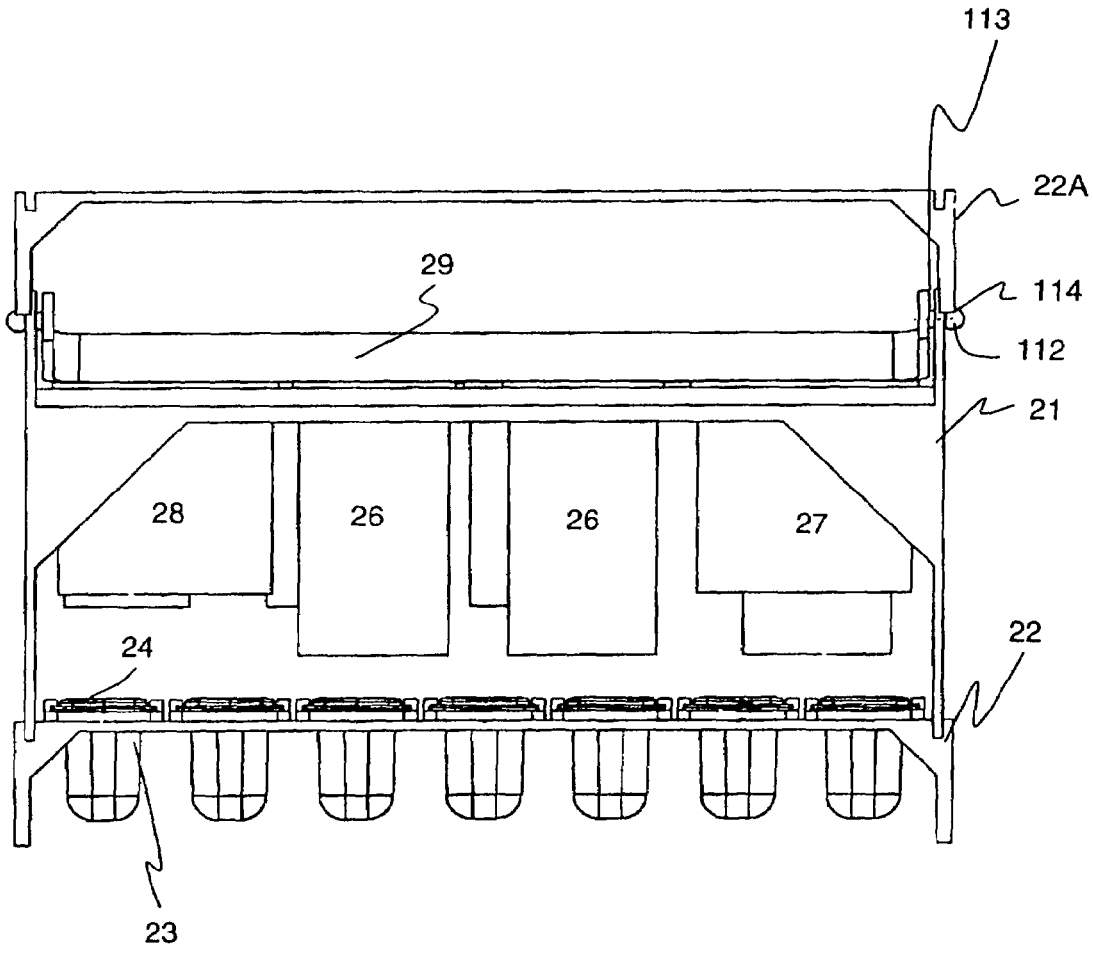
FIG. 12 shows a plan view of the medicine organizer as depicted in FIG. 1.
Figure 13:
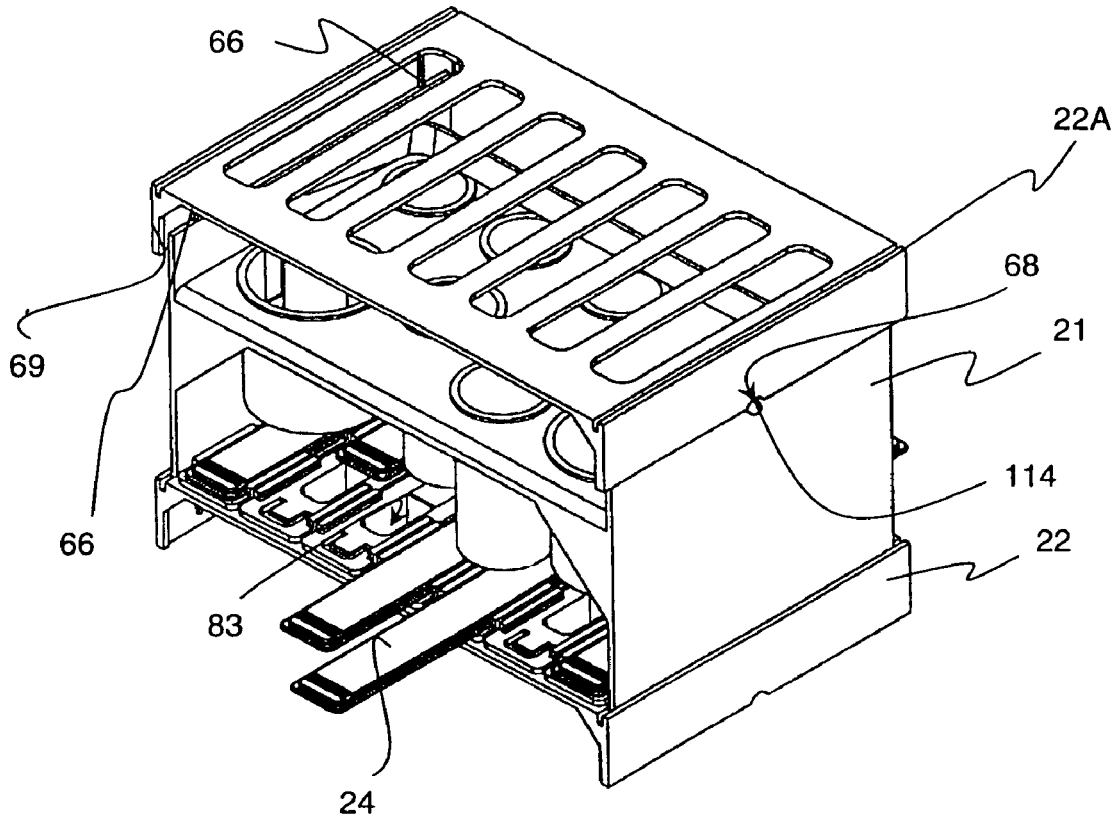
FIG. 13 shows a perspective view of the medicine organizer assembly as in FIG. 1 and having the lower portion of a like medicine organizer nested thereabove.

With reference now to FIGS. 1, 12 and 13, medicine organizer 20 also includes a handle 29. Handle 29 includes vertical portions 110 and a horizontal portion 111. Handle 29 also includes laterally-extending snaps 112 (FIG. 12) for providing a rotatable connection of handle 29 to upper frame member 21 via apertures 49 (FIG. 2). In particular, snaps 112 include a first cylindrical portion 113 terminating in a generally bulbous portion 114 such as a sphere or section of a sphere having a maximum diameter greater than that of cylindrical portion 113, and slightly larger than that of aperatures 49. In this fashion, vertical arms of 110 of handle 29 can be deflected slightly inwardly to position bulbous portions 114 adjacent the inside of apertures 49, and bulbous portions 114 forced through apertures 49 to provide a snap fit, whereafter cylindrical portions 113 are received and rotatable within apertures 49 to provide a rotable connection between the handle 29 and the upper frame member 21.

With reference to all of the Figures, and in particular to FIGS. 1, 12 and 13 showing assembled organizers, various aspects of the use of the preferred medicine organizer 20 will now be described. In general terms, medicine organizer 20 includes the upper frame member 21 providing a bottle storage function and a lower frame member 22 providing an individual pill storage function. In this fashion, both pill bottles, potentially containing longer-term supplies, and individualized pills can be stored in the same organizer. Further, the pill storage unit of the organizer 20 incorporates multiple trays 23 each having its own tray lid 24, and each divided into plurality of subcompartments 83. Trays 23 and their respective containers 71 and subcompartments 83 can be of any suitable size and are preferably sized to contain a supply of individual pills to be taken on a periodic basis, such as a daily basis. The pill storage unit of the organizer 20 provides for highly flexible use. For example, where seven trays 23 are provided as illustrated, each tray can contain pills to be taken on a given day of the week. The trays can be labeled as such if desired. Furthermore, the containers 71 and their subcompartments 83 can be sized to contain a pill supply to be taken all on a given day of the week thus emptying the tray 23 of pills each day, or may be sized to contain a multiple-week supply of pills to be taken on a given day of the week. Similarly, where a patient has a dosage regimen wherein pills are to be taken at given intervals each day, subcompartments 83 may be used to contain the pill or set of pills to be taken at those intervals. When used in this fashion, the tray lid 24 can be left at the friction stop position leaving open the subcompartment from which pills have already been taken that day to provide a readily visible indication of that fact. These and other similar uses of the tray system of the medicine organizer 20 of the invention will be apparent to those working in the field.

In another aspect of the invention, the upper frame member 21 including the bottle storage or holding unit is removably attached to the lower frame member 22 including the individual pill holding unit. In this fashion, either may be transported individually away from the home, for example to a physician's office, pharmacy, on vacation, etc. Thus, for example, should a patient wish to visit a physician and take along various medications in a prescribed regimen, the upper frame member 21 can be separated from the lower frame member 22 and transported to the physician's office. On the other hand, should the patient need to take along a supply of individual pills for periodic consumption, the patient can detach lower frame member 22 including the individual pill storage unit and transport the same. Similarly, when desired, a patient may remove an individual pill tray 23 with lid 24 and transport the same for use. For normal usage in one's residence, preferred medicine organizer 20 is sized to be receivable within standard residential cabinetry so that medicine organizer 20 can be stored out of site yet readily accessible. When so stored, organizer 20 can be stored in its assembled fashion as shown in FIG. 1 or, alternatively, handle 29 can be folded to its downward position and lower frame member 22 can be positioned atop upper frame member 21 to provide more ready access to the trays 23.

Further, should more than one organizer 20 be required to store and dispense the prescriptions of a single patient, or should multiple patients exist in the same residence, two identical medicine organizers as depicted in FIGS. 1 and 12 may be nested with one resting atop the other. With reference to FIG. 13, shown is such a nesting relationship of a second lower frame member 22A atop an upper frame member 21. In this nesting relationship, arcuate cutouts 68 of lower frame member 22 rest upon bulbous portions 114 of handle 29, and lower surfaces 67 of proturbances 66 contact top edges 32 and 35 of support members 30 and 31. It will be understood that a second upper frame member could be removably attached to the second lower frame member 22A to provide a complete second organizer 20.

The medicine organizer 20 of the invention and components thereof can be made of any suitable material of construction and by molding, fabrication and/or other conventional manufacturing techniques. Plastic materials are preferred, including for example acrylic, polypropylene, or any other suitable plastic material.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A medicine organizer useful for storing and dispensing pills, comprising:

an organizer body having an upper end, a lower end, and side walls connecting said upper end and said lower end;

said upper end and said lower end configured to provide a nestable relationship among two of said organizer bodies;

a bottle storage unit of said organizer body, said bottle storage unit configured to retain a plurality of pill bottles in fixed locations;

a pill storage unit of said organizer body for receiving a supply of pills to be taken on a periodic basis, said pill storage unit having a plurality of pill compartments each for receiving a supply of pills;

wherein said pill storage unit comprises a plurality of individual pill trays providing said plurality of pill compartments;

wherein said organizer body comprises an upper frame removably connected to a lower frame, said upper frame providing said bottle storage unit, and said lower frame providing said pill storage unit; and said individual pill trays are each removable from said lower frame of said organizer body;

wherein said individual pill trays each include a removable tray lid;

wherein said lower frame includes a plurality of tray openings for receiving said trays;

wherein said individual pill trays are each divided into a plurality of pill subcompartments;

wherein said tray lids are slidably received within recesses of said pill trays, and wherein said tray lids are slidable to selectively open one or more subcompartments of said pill trays while leaving remaining subcompartments closed.

2. A medicine organizer according to claim 1, wherein said bottle storage unit is removably connected to said pill storage unit.

3. A medicine organizer according to claim 1, wherein:

said organizer body comprises an upper frame removably connected to a lower frame, said upper frame providing said bottle storage unit, and said lower frame providing said pill storage unit.

4. A medicine organizer according to claim 1, wherein:

said upper frame includes a plurality of bottle openings.

5. A medicine organizer according to claim 1, wherein:

said tray lids and pill trays cooperate to provide stops corresponding to said subcompartments.

6. A medicine organizer according to claim 5, wherein:

said stops are provided by detent members on said pill trays and cooperating recesses on a lower surface of said tray lids, said cooperating recesses positioned to contact said detent members when said tray lids are slidably opened to expose individual ones of said subcompartments.

7. A medicine organizer according to claim 3, also comprising a handle connected to said organizer body.

8. A medicine organizer according to claim 7, wherein:

said handle is pivotally connected to said upper frame, said handle pivotal between an upright position for carrying said upper frame, and a lateral position facilitating said nestable relationship.

9. A medicine organizer according to claim 6, wherein:

said upper frame has a pair of opposed, downwardly-extending support walls presenting a pair of support wall edges;

said lower frame has a pair of grooves; and said support wall edges are removably received within said grooves.

10. A medicine organizer according to claim 9, wherein:

said upper frame includes a pair of nestable proturbances; and said lower frame includes a pair of recesses for receiving the nestable proturbances of a second one of said upper frames.

11. A medicine organizer according to claim 1, wherein:

said bottle storage unit includes a panel defining a plurality of openings of differing size.

12. A medicine organizer useful for storing and dispensing pills, comprising:

an organizer body;

a bottle storage unit of said organizer body, said bottle storage unit configured to retain a plurality of pill bottles in fixed locations;

a pill storage unit of said organizer body for receiving a supply of pills to be taken on a periodic basis;

said pill storage unit having a plurality of pill compartments each for receiving a supply of pills;

said pill storage unit comprising a plurality of individual pill trays providing said plurality of pill compartments;

wherein said individual pill trays each include a removable tray lid;

wherein said individual pill trays are each divided into a plurality of pill subcompartments; and wherein said tray lids are slidably received within recesses of said pill trays, and wherein said tray lids are slidable to selectively open one or more subcompartments of said pill trays while leaving remaining subcompartments closed.

13. A medicine organizer according to claim 12, wherein: said organizer body has an upper frame member removably connected to a lower frame member.

14. A medicine organizer according to claim 13, wherein: said lower frame includes a plurality of tray openings for receiving said trays.

15. A medicine organizer according to claim 12, wherein: said tray lids and pill trays cooperate to provide stops corresponding to said subcompartments.

* * * * *